US009561417B2

(12) United States Patent
Rodriguez

(10) Patent No.: US 9,561,417 B2
(45) Date of Patent: Feb. 7, 2017

(54) SLIDING HANDLE TRAINING BAT

(71) Applicant: Juan Rodriguez, Wellington, FL (US)

(72) Inventor: Juan Rodriguez, Wellington, FL (US)

( * ) Notice: Subject to any disclaimer, the term of this patent is extended or adjusted under 35 U.S.C. 154(b) by 0 days.

(21) Appl. No.: 14/622,703

(22) Filed: Feb. 13, 2015

(65) Prior Publication Data

US 2015/0224381 A1 Aug. 13, 2015

Related U.S. Application Data

(63) Continuation of application No. 61/939,707, filed on Feb. 13, 2014.

(51) Int. Cl.

| | |
|---|---|
| ***A63B 69/00*** | (2006.01) |
| ***A63B 71/06*** | (2006.01) |
| ***A63B 15/00*** | (2006.01) |
| ***A63B 15/02*** | (2006.01) |

(52) U.S. Cl.

CPC ..... *A63B 69/0002* (2013.01); *A63B 15/005* (2013.01); *A63B 15/02* (2013.01); *A63B 59/50* (2015.10); *A63B 59/59* (2015.10); *A63B 60/16* (2015.10); *A63B 60/46* (2015.10); *A63B 60/50* (2015.10); *A63B 71/0622* (2013.01); *A63B 59/58* (2015.10); *A63B 2060/002* (2015.10); *A63B 2069/0008* (2013.01); *A63B 2071/0625* (2013.01); *A63B 2071/0694* (2013.01); *A63B 2207/02* (2013.01); *A63B 2208/0204* (2013.01); *A63B 2210/50* (2013.01); *A63B 2220/20* (2013.01); *A63B 2220/30* (2013.01); *A63B 2220/40* (2013.01); *A63B 2225/50* (2013.01)

(58) Field of Classification Search

USPC ..... 473/457, 564, 296

See application file for complete search history.

(56) References Cited

U.S. PATENT DOCUMENTS

| | | | | |
|---|---|---|---|---|
| 6,599,200 | B1 * | 7/2003 | Kallassy | A63B 69/3632 473/203 |
| 2003/0013563 | A1 * | 1/2003 | Ryan | A63B 69/0002 473/457 |
| 2006/0025246 | A1 * | 2/2006 | Forney | A63B 15/00 473/457 |

* cited by examiner

*Primary Examiner* — Gene Kim
*Assistant Examiner* — Rayshun Peng
(74) *Attorney, Agent, or Firm* — Allen F. Bennett; Bennett Intellectual Property

(57) ABSTRACT

A training bat has a central rod extending through the longitudinal length of the bat. A knob may be located at a proximal end of the bat. A handle located immediately distal to the knob may slide along the length of the rod. A cone section may be located distal to the handle. The knob and cone section may limit the longitudinal sliding of the handle. A barrel section may be located distal to the cone section. If the barrel section includes an interior chamber, the distal end of the barrel section may include a removable cap. Weights, springs, pins and other objects may be located inside the barrel section. Electrical components or other devices may also be included in the cone section, barrel section or cap. The handle may include an acoustic chamber and an amplifying chamber to provide for emission of a sound when the bat is swung. The acoustic chamber and amplifying chamber may also incorporate safety features.

2 Claims, 4 Drawing Sheets

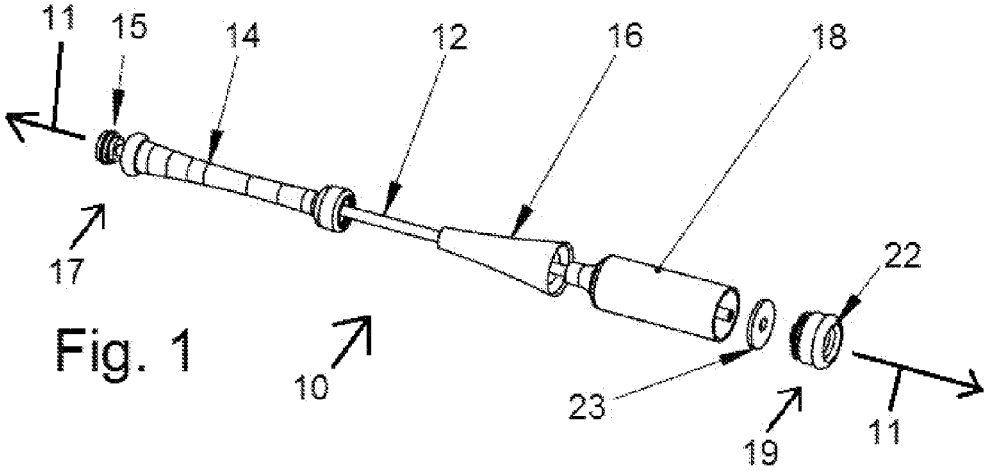
Fig. 1
Fig. 2
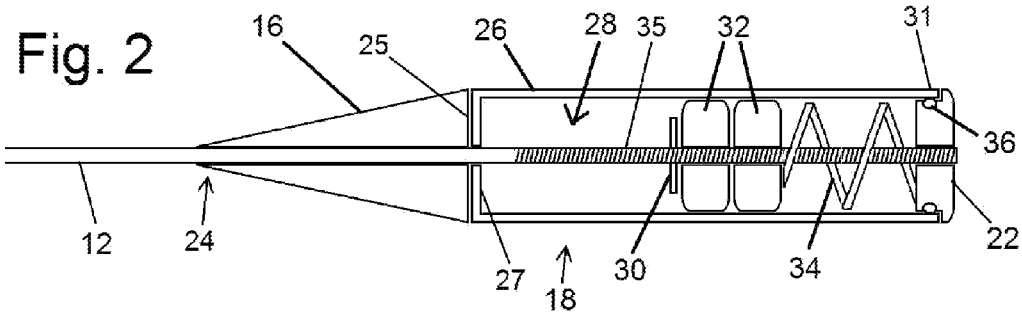
Fig. 3
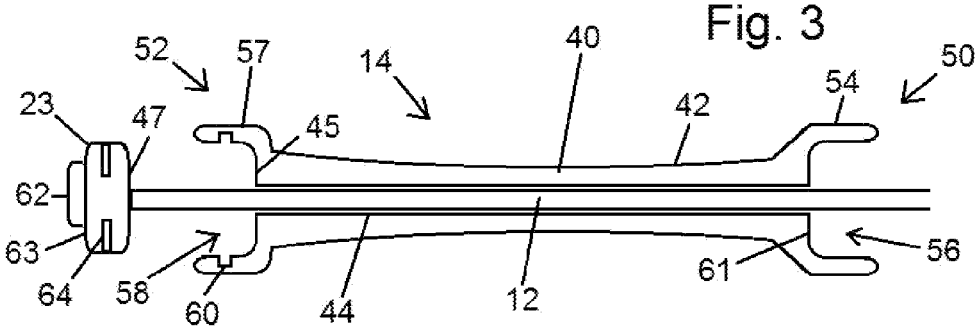

Fig. 7
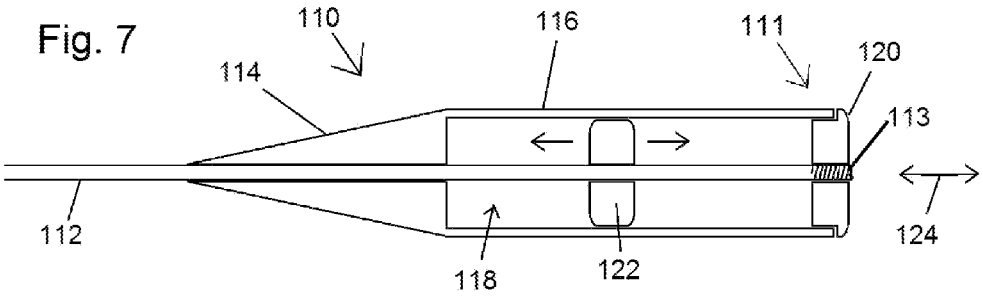
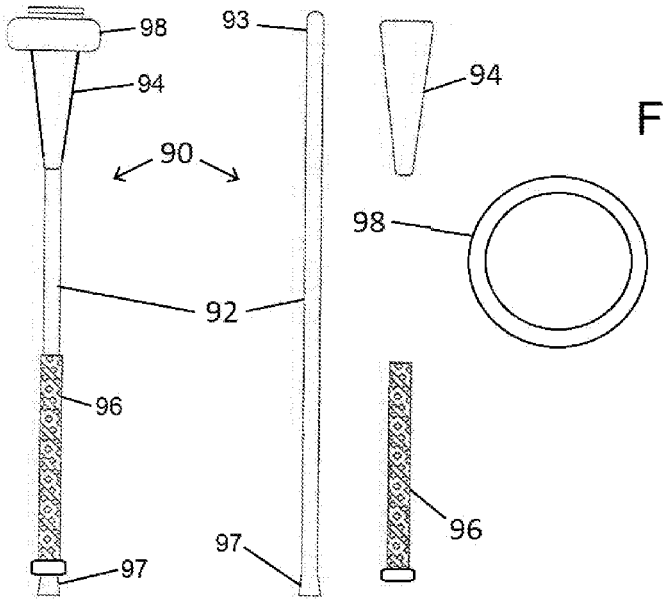
Fig. 8
Fig. 9
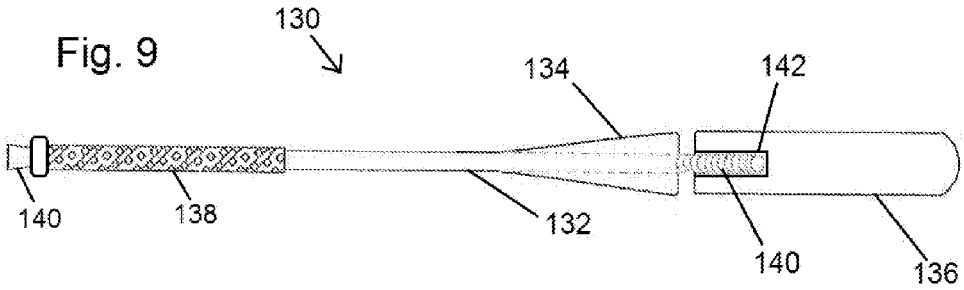

SLIDING HANDLE TRAINING BAT

CROSS-REFERENCE TO RELATED APPLICATIONS

This application claims priority to U.S. Provisional Application Ser. No. 61/939,707 filed on Feb. 13, 2014, the contents of which are hereby incorporated in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

Field of the Invention

The present invention relates to devices and methods for training athletes. More particularly, the invention relates to devices, systems and methods to improving an athlete's swing of a baseball bat or other device.

Description of the Related Art

Many devices and techniques have been developed to improve athletic performance of baseball players. Bat swing practice means of various kinds have been conventionally proposed and used. For example, there is known a bat swing practice means in which a weight having a predetermined weight value is slidably placed on a bat-shape shaft body to be swung.

In the past, a variety of exercise or warm-up devices have been provided for use by baseball players. Persons who play baseball, softball, and similar sports, often use various devices and methods to improve their batting skills. For example, players may utilize a plurality of bats, a single bat with weighted collars or clamps and the like attached thereto, permanently weighted bats (e.g. hollowed out bats with solid or flowable weight materials included therewithin), or a bat with attached vanes or the like to effect aerodynamic drag. Such devices and methods are employed to facilitate general warming-up, stretching muscles, and developing the muscles used for batting, as well as to improve a player's bat speed, reaction skill, bat control, and the like. Swinging a plurality of bats can be awkward, and there is a limit as to how many bats a person can swing safely and/or comfortably.

Unlike power hitting, in which a bat is swung at a ball with immediate acceleration for high speed so as to gain maximum momentum and great impact upon contact with a pitched ball, contact hitting requires a more controlled swing in which the bat is drawn more slowly toward contact with the ball, with minimal acceleration, and the wrists of the batter are turned just prior to making contact with the ball so as quickly to accelerate, or "snap", the bat for accurate placement of the hit ball. While many training devices have been proposed for increasing proficiency in power hitting, these devices are not suited to learning the controlled swing necessary in contact hitting, and especially in connection with hitting in soft ball play.

Further, none of these existing devices assist an athlete and/or trainer in identifying problems with an athletes bat swing such as, for example, the amount of twisting done to the bat during a swing, or whether a wrist is actuated at the proper time and to the proper extent to optimize performance.

Further, none of the existing devices assist an athlete in learning to naturally assume proper stance and posture, or to maintain proper stance and posture while simultaneously minimizing negative twisting, or rolling of the bat during a swing.

In view of the foregoing, there is a need to provide means by which and athlete and trainer may isolate and identify many distinct aspects of an athlete's posture, stance and kinetics as they relate to baseball performance.

BRIEF SUMMARY OF THE INVENTION

Disclosed is a training bat having a central rod extending through the longitudinal length of the bat. A knob may be located at a proximal end of the bat. A handle may be located immediately distal to the knob and capable of sliding along a portion of the length of the rod. A cone section may be placed distal to the handle and may limit the distance to which the handle may distally slide along the rod. A barrel section may be located distal to the cone section. If the barrel section includes an interior chamber, the distal end of the barrel section may include a removable cap. Weight, Springs, pins and other objects may be located inside the barrel section. Electrical components or other devices may also be included in the cone section, barrel section or cap.

In one embodiment, the cone section and barrel section are individual components. Weights may be placed inside an interior chamber of the barrel section. Weight placed inside the barrel section may have a toroidal shape and may be placed around a Rod that extends through the interior chamber. A cap may seal the interior chamber.

In some embodiments, the handle may include a proximal acoustic chamber optimized for producing sound when the handle impacts the knob during a swing. The acoustic chamber may be designed to maximize the volume and minimized the duration of a sound generated by the knob impacting the handle. The distal end of the handle may include an amplifying chamber having cylindrical walls that may impart a bell or bullhorn shape to the amplifying chamber. The walls of the acoustic and amplifying chambers also function as a safety feature to minimize the likelihood of an operator pinching a hands or other body part.

It is therefore an object of the present invention to provide a training bat for assisting baseball players in improving their swing. It is also an object of the present invention to provide a training bat capable of producing a sounds when its handle slides down to the proximal end of the bat.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIG. 1 is a perspective exploded view of a training bat in accordance with the principles of the invention;

FIG. 2 is a side cross-sectional view of a cone section and barrel section of a training bat in accordance with the principles of the invention;

FIG. 3 is a side cross-sectional view of a handle and knob of a training bat in accordance with the principles of the invention;

FIG. 7 is a side cross-sectional view of an alternative embodiment of a cone section and barrel section of a training bat in accordance with the principles of the invention;

FIG. 8 is a side view of an alternative embodiment of a training bat and its components in accordance with the principles of the invention;

FIG. 9 is a side view of an alternative embodiment of a training bat in accordance with the principles of the invention;

DETAILED DESCRIPTION

Figure 4:
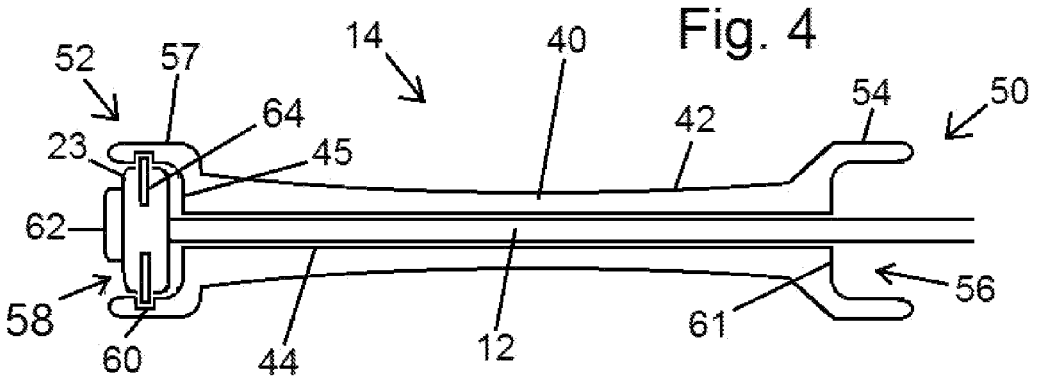
FIG. 4 is a side cross-sectional view of a handle and knob of a training bat in accordance with the principles of the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

FIG. 1 shows a training bat 10 in accordance with principles of the invention. The training bat 10 may have a length defined by a proximal end 17 and a distal end 19. In this exploded view, many salient features of training bat 10 are apparent. A rod 12 may extend longitudinally along substantially the entire length of the training bat 10. The rod 12 may be, as shown here, a cylindrical rod having a substantially circular cross-section. However, it may be desirable to use a Rod having one or more flat faces and having a cross-section that is not completely circular or having a polygonal shape. It may also be desirable to include one or more slots extending longitudinally or radially about the exterior of the Rod. Slots, grooves, and protrusion on the rod 12 may be used to engage other components of the training bat 10.

For clarity, references may be made throughout this disclosure to a longitudinal axis 11, along which rod 12 runs parallel, and references may be made to various objects or components as being distal or proximal to one another along longitudinal axis 11. In addition, there may be a substantial amount of radial symmetry in the components centered about longitudinal axis 11.

A cone section 16 may be substantially conical or frustoconical, and may be positioned about the rod 12. The cone section 16 may impart to training bat 10 and appearance more similar to a classic that they may would have without the cone section 16. The cone section 16 may optionally be removable and may optionally be weighted and may optionally have an adjustable weight. The cone section 16 may be hollow, solid, or may contain a frame, storage compartment, or other internal structure.

The proximal end 17 of the training bat 10 may include a knob 15 that may have a greater diameter or width, then the rod 12. A handle 14 may be positioned about the rod 12 between the cone section 16 and the knob 15. The handle 14 may be configured to freely slide up and down the longitudinal length of the rod 12 between the knob 15 and the cone section 16. The handle 14 may have a general shape, configuration and structure comparable to the handle portion of a regular bat. The handle 14 may optionally be configured to rotate freely about the rod 12 or optionally configured such that it may not rotate in relation to the rod 12.

A barrel section 18, may be located distally to the knob 15, handle 14 and cone section 16. The proximal end of barrel section 18, may abut the wider, distal end of the cone section 16. The cone section 16 may optionally be attached either removably or permanently to the barrel section 18. The barrel section 18, may be substantially hollow having an internal chamber. The rod 12 may extends distally through the entire length of the barrel section 18 and may all or a portion of the rod 12 may be threaded or smooth.

A weight 23 may have a relatively toroidal shape such that it may be placed with in the barrel section 18 and around the rod 12. Weight 23 may include threading through its central hole, or may otherwise be designed to engage one or more devices for proper positioning of the weight 23 within the barrel section 18. The most distal component of the training bat 10 may be a removable 22 that may be removed. In order to access the interior of the barrel section 18.

FIG. 2 provides a cross-sectional view of the cone section 16 and the barrel section 18. Cone section 16 may include a distal end 25 having a diameter approximately equal to the diameter of the barrel region 18. The cone section 16 may taper in the proximal direction along axis 11 such that its proximal end 24 has a diameter only slightly larger than the diameter of the rod 12. In this embodiment, distal end 25 of the cone section 16 is flush with and abuts against the proximal end 27 of the barrel section 18. It may be desirable for the cone section 16 and the barrel section 18 to be formed from a single unitary body, or be otherwise integrated by for example, removable or permanent affixation to one another. It may be desirable for the cone section 16 and the barrel section 18 to be capable of rotating in relation to one another.

In this embodiment, cone section 16 has a frustoconical shape. Optionally, cone section 16 may have a diameter that decreases in a stepwise rather than gradual manner from the distal to the proximal end. It may also be desirable for the cone section 16 to be completely removed. In embodiments that do not include a cone section, the barrel section may be longer. It may also be desirable for cone section 16 to include various ornamental or other features, such as blinking lights, devices for producing sound and other circuitry or may optionally include team or brand logos.

Barrel section 18, may be substantially cylindrical and may have substantially the same diameter at both proximal end 27 and distal end 31. In this embodiment, rod 12 extends through the entire length of the barrel section 18. Rod 12 may be smooth, or may include threading and may include other surface textures or features. In this embodiment, rod 12 includes a distal threaded region 35.

A pin 30 extends through rod 12, thereby limiting the extent to which weights 32 may travel into the interior chamber 28 defined by cylindrical outer wall 26. Other devices, such as a washer, spring or other device may be used to limit the extent to which a weight or other object may travel into the interior chamber 28. In this embodiment, two weights 32 and have been placed into the interior chamber 28. A cap 22 covers and seals the distal end 31 of the barrel section 18. Cap 22 may screw on to the threaded region 35 of the rod 12. Cap 22 may include an O-ring 36 that may facilitate hermetic sealing between the cap 22 and the distal end 31 of the barrel section 10, and may also prevent the cap 22 from unscrewing during use. A spring 34 may be placed with in the interior chamber 28 distal to the weight 32, thereby imparting a bias in the proximal direction against weight 32. As a result, the weight 32 may be held securely in place such that they do not slide back and forth, longitudinally while the training bat 10 is in use. Optionally, a spring 34 may not be included, thereby permitting weight 32 to slide longitudinally along Rod 12. By optionally removing 1030, weight 32 may be free to move longitudinally along the entire length of the barrel section 18, from the proximal and seven to the distal end 31.

FIG. 3 shows the handle 14 in more detail. Handle 14 may be substantially radially symmetric, surrounding a Rod 12, which may traverse door 44 positioned down the middle of the body 40 of the handle 14. The distal and 50 of the handle 14 may include a cylindrical wall 54, which along with floor 61 defines an amplifying chamber 56. As will be explained in more detail, the amplifying chamber 56 may be an important feature of the training bat 10, by increasing safety and increasing an audio signal generated during operation of the training bat 10.

Body 40 may have a concave exterior surface 42. It may be desirable for the exterior surface 42 of the body 42. Have a size, shape, appearance and feel of a standard baseball bat. Therefore, it may be desirable for the exterior surface 42 to be knurled, ribbed or otherwise textured. Optionally, tape may be wrapped about the handle 14 substantially covering exterior surface 42 to further emulate a standard baseball bat.

The proximal end 52 of the handle 14 may also include a cylindrical wall 57, which along with the tympanic panel 45 defines a proximal acoustic chamber 58. The interior sides of walls 57 may include one or more niches 60 into which a locking pin 64 may be inserted when an operator desires to lock the handle 14 into a stationary position.

The knob 23 located at the proximal end of the rod 12. It may include on its exterior, proximal surface 63 a locking lever 62. When the locking lever 62 is rotated, locking pins 64 extend outwardly from the knob 23 such that they may engage niches 60 and thereby secure the handle 14 at the proximal end of the training bat 10. Knob 23 may optionally incorporate any other suitable mechanism for locking a handle 14 to the proximal end of a training bat 10. Optionally, a training bat may not provide a means for locking into place, the handle 14.

Knob 23 may include a percussion panel 47 located on its distal side. Percussion panel 47 and tympanic panel 45 may be designed to emit a loud cracking or popping sound when they come in contact with each other. During operation of the bat, an operator may practice stance and form by listening for the sound emitted. During a swing, centripetal force may pull the barrel section outward and away from the handle. As the handle 14 slides along rod 12 and a proximal direction, it's sliding may be stopped when the percussion panel 47 impacts tympanic panel 45, thereby stopping handle 14's sliding motion relative to the rod 12 and emitting a sound. When an operator swings the training bat 10 properly, the sound will be emitted when the bat attains a particular predetermined position relative to the operator. Therefore, it may be desirable to provide a tympanic panel 45 and a percussion panel 47 that may be optimized to produce a sound having maximized volume, but minimized duration. A short loud sound may assist in operator in determining more precisely the correctness of his or her form.

The body 40 of the handle 14 may be preferably constructed of a material capable of transmitting sound waves very efficiently and quickly from the acoustic chamber 58 to the amplifying chamber 56. Without being bound by theory, the inventor believes that the cylindrical wall 54 about amplifying chamber 56 may result in the sound created in the acoustic chamber 58 being amplified when it reverberates through the chamber floor 61 and walls 54 of the amplifying chamber 56. That is, the shape of the amplifying chamber may operate under the same acoustic principles as a bullhorn or similar device. It may also be desirable for the body to be constructed of a material that may be sturdy enough to withstand repeated impingement so substantial force by percussion panel 47 on tympanic panel 45. It may also be desirable for body 40 to be constructed of a material that may be both durable and capable of transmitting the emitted sound while retaining its maximized volume and minimized duration. This may be desirable in order to maximize the amplifying nature of the amplifying chamber 56. Again without being bound by theory, the inventor believes that the acoustic chamber 58 of the handle 14 may also amplify the sound emitted by the impinging of percussion panel 47 on tympanic panel 48 by virtue of its side walls 57.

FIG. 4 shows the handle 14 and knob 23 locked together by the insertion of pins 64 into niches 60. The training bat 10 may be used in practice more like a regular bat when handle 14 is locked onto the knob 23. This configuration may also be advantageous when an operator desires to store the training bat 10. As mentioned above, other means of securing the handle 14 to the knob 23 may be any suitable mechanism known in the art, for example. Threading on the interior walls 57 may be used to screw the knob 23 into the acoustic chamber 58. Latches, straps, pins, screws or any other suitable mechanism. Optionally, it may be desirable for the handle to be designed to be secured to the code section in place of or in addition to the securement at the proximal region of the bat.

Both acoustic chamber 58 and amplifying chamber 56 may serve an additional purpose in serving as safety features as well as devices for generating an effective sound. When a bat is swung rapidly, substantial centripetal force may be imparted at the distal end of the training bat 10, causing the handle 14 to slide proximally very rapidly. Were the location of the stopping impact, located at tympanic panel 45 and percussion panel 47 exposed, an operator may inadvertently pinch a finger or other region of the palm. This may result in substantial pain and even serious injury. By providing a cylindrical wall 57 that substantially conceals the point of impact, the training bat 10 may be very safe to handle even by children of a young age. The locations on the training bat 10 that may pose a pinching danger may be removed to a distant safely away from the exterior surface 42 of the handle 14 where an operator's hands would be placed.

Figure 5:
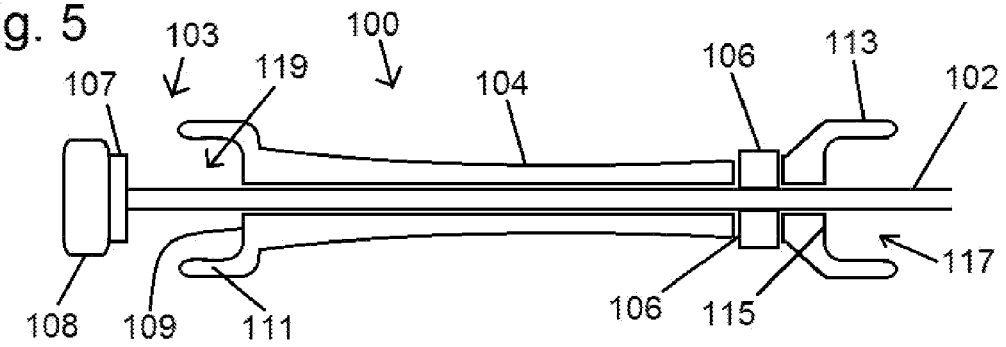
FIG. 5 is a side cross-sectional view of an alternative embodiment of a handle and knob of a training bat in accordance with the principles of the invention.

FIG. 5 shows an alternative embodiment of a handle 100 and a knob 108 at the proximal end 103 of the rod 102. Handle 100 may include an amplifying chamber 117 defined by the cylindrical sidewall 113 and the chamber floor 115. The acoustic chamber 119 may be defined by the tympanic panel 109 and the cylindrical wall 111. Handle 100 may also include one or more breaks 106. The breaks 106 may be adjusted radially, being moved closer or further from the rod 102. By positioning the breaks 106, such that they impinge upon rod 102, an operator may adjust the speed at which the handle 100 traverses the rod 102.

The knob 108 includes a percussion panel 107 that has not been formed as an integral part of the knob 108. Instead, percussion panel 107 may be comprised of a particular material and/or configuration in order to maximize the volume of or shorten the duration of a sound created in the acoustic chamber 119 when percussion panel 107 impinges upon tympanic panel 109. Optionally, percussion panel 107 may be designed to reduce the amount of noise created. This may be desirable when an operator desires to minimize the noise of training. There is no locking mechanism on the knob 108. Instead, application of the breaks 106 may lock the handle 100 at any location along the rod 102.

Figure 6:
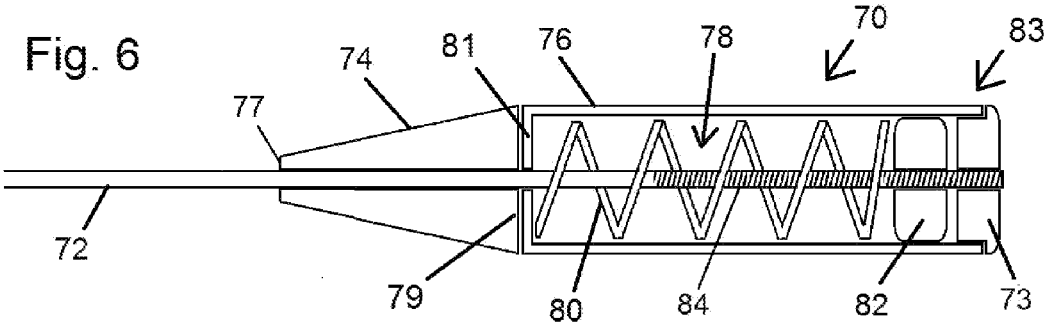
FIG. 6 is a side cross-sectional view of an alternative embodiment of a cone section and barrel section of a training bat in accordance with the principles of the invention.

FIG. 6 shows an alternative embodiment of a barrel section 70 and a cone section 74. In this embodiment, the cone section 74 has a more fresh to conical shape because the proximal end 77 of the cone section 74, has been slightly truncated. The proximal end 77, forming a small planar surface perpendicular to the rod 72 and the longitudinal axis of the bat. As a result, proximal end 77 may abut the floor of the acoustic chamber of a handle positioned proximal to the cone section. This may prevent the proximal end 77 of the cone section 74, from entering the bore of a handle which the rod 72 traverses.

The distal end 79 of the cone section 74 may be substantially flush with and abut the proximal end 80, one of the barrel section 70. Cone section 74 may be secured in place and in the proper orientation by any suitable means. Cone section 74 may be secured to the rod 72 and/or the barrel section 70. The cone section 74 may optionally be formed as an integral part of or as a unitary body with either the rod will will 72 or the barrel section 70. The cone section 74 may perform a variety of functions including creating an appearance similar to a standard baseball bat. The cone section 74 may have one or more concave, convex or angular sections or surfaces. It may be formed from rigid or flexible material.

The barrel section 70 may be comprised of a proximal end 81 and a cylindrical wall 76 that may define an interior chamber 78. The interior chamber 78 may be substantially cylindrical. However, like other components in accordance with the principles of the invention, the interior chamber may be preferably radially symmetric, and may have a variety of three-dimensional shapes, such as for example, an ellipsoid or a polygonal prism. In this embodiments, a spring 84 may be placed in the proximal end 81 of the barrel section 70, around the rod 72, which traverses the barrel section 70 along its axis of symmetry. A cap 73 may be removably attached to the distal end 83 of the barrel section 70. In this embodiment, the cap 73 may be removably attached by engaging the threading of the threaded region 84 of the rod 72 and screwed into place. The cap 73 may optionally be attached by engaging threading on the interior side of the cylindrical wall 76, may snap into place more be removably affixed by other means.

The cap 73, like The cone section 74, may be comprised of a rigid or flexible material. It may be solid, or it may include internal cavities. Either the cone section 74 or the cap 73 may include electronics for emitting lights and/or sound. It may be desirable to incorporate a device into either the cap 73 or the cone section 74 that emits a light or noise when a predetermined amount of centrifugal or centripetal force is detected, when a predetermined amount of torque force is detected or upon detection of other forces.

A weight 82 may be inserted into the internal chamber 78 through the distal end 83 of the barrel section 70. The spring 80 may impart to the weight 82 a bias toward the distal end 83 of the barrel section 70. This may prevent the weight from sliding longitudinally and traversing the interior cavity 78. Such movement may be undesirable. Optionally, a spring may be placed both distally and proximally to weight 82. Optionally, the weight 82 may be Incorporated into the cap 73. This may eliminate the need to incorporate a spring 80 into the interior chamber 78.

In this embodiment, the interior chamber is relatively large and the cylindrical wall 76 is relatively thin. The bat may optionally utilize a solid barrel section 70 having no internal chamber. Where the barrel section 70 has no interior chamber, the cap 73 may be an unnecessary component. Optionally, the interior chamber 78 may be accessed from locations other than the distal end 83. For example, one or more openings may be located in either the cylindrical wall 76 or the proximal end 81.

FIG. 7 shows another alternative embodiment of a barrel section 110 having a cone section 114 integrated such that the to form a single unitary body. The cone section 114 tapers and a proximal direction along longitudinal axis 124, which may also serve as an axis of symmetry. A cylindrical wall 116 along with the cone section 114 defines an interior chamber 118. A weight 122. In this embodiment may move freely within the interior chamber 118. A cap 120 may cover a distal opening at the distal end 111 of the barrel section 110. The cap 120 may be removably engaged with a threaded section 113 of the Rod 112.

FIG. 8 shows an alternative embodiment of a training bat 90. The training bat 90 may be of a simpler design. It may include a rod 92 having a flange 97 at its proximal end. A handle 96 may be slid over the distal end 93 of the rod 92. A cone section 94 may then be attached to the distal end 93 of the rod 92. A weight 98 may optionally be affixed to the cone section 94. Those skilled in the art will appreciate that annular weights 98 are known for use with baseball bats to improve a baseball players swing. The handle 96 may slide along the length of the rod 92 between the cone 94 and the flange 97. This embodiment does not include features such as an acoustic chamber and an amplifying chamber.

FIG. 9 shows another alternative embodiment of a training bat 130 in accordance with principles of the invention. Training bat 130 includes a rod 132, about which a handle 138 may be placed. As a flanged proximal end 140 prevents the handle 138 from sliding off the Rod 132. A cone section 134 may be affixed to rod 132, and may prevent the handle 138 from sliding off the distal end 140 of the rod 132. The distal end 140 of the Rod 132 may be threaded and may be configured to engage threaded bore 142 of a barrel section

136. The barrel section 136 in this embodiment is solid and may have a predetermined weight. The barrel section 136 may be removed and replaced with alternative barrel sections having different weights.

Figure 10:
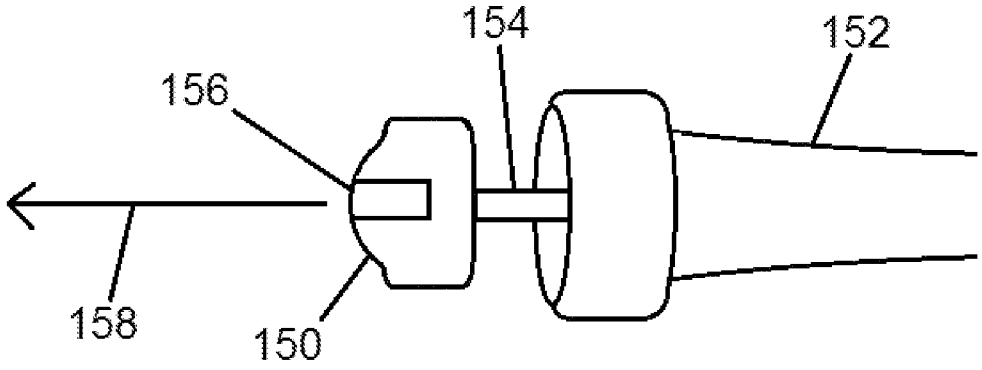
FIG. 10 is a cross-sectional side view of an alternative embodiment of a knob of a training bat in accordance with the principles of the invention.

FIG. 10 shows an alternative embodiment of a knob 150 at the proximal end of a Rod 154 and handle 152. The knob 150 includes a small laser 156 that may emanate a laser beam 158 and a proximal direction. The laser 156 may be comparable to a laser pointer as is commonly used with a laser pointer pen, or a keychain. When an operator uses a baseball T stand, he or she may adjust the position of the baseball bat such that the laser beam 158 points that and lands upon a ball atop a T stand prior to initiating a swing. Once the laser beam 158 is aligned such that it hits a baseball, an operator may initiate a swing. This may further improve the operator swing.

Figure 11:
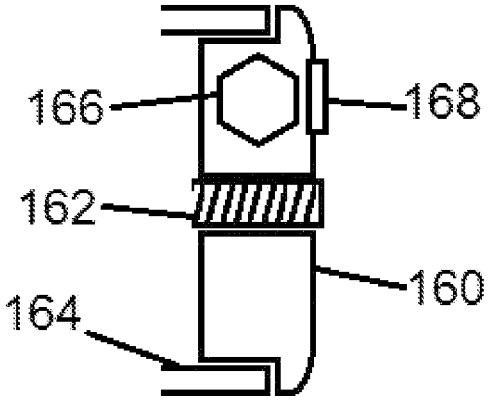
FIG. 11 is a cross-sectional side view of an alternative embodiment of a cap of a training bat in accordance with the principles of the invention.

FIG. 11 shows an alternative embodiment of a cap 160 for use on the distal end of a baseball bat. The 160 may engage the threaded region of a Rod 162 and the sidewall 164 of the barrel of a training bat. The cap 160 may house, a sensor package 166. The sensor package 166 may include an accelerometer, a motion sensor and other components. When a training bat is swung, it may detect and record the velocity, acceleration, torque force and other physical data. The 160 may include a screen 168 on the exterior of the cap 160 and/or a transmitter. A screen 168 may provide the information recorded by the sensor package 166. Optionally, the sensor package 166 may transmit the recorded data to an electronic device, for example, a cell phone. The sensor package 166 may include Bluetooth®, or other signal transmission technology and may also interact with a smart phone application or other software. This may allow an operator practicing with a bat and/or his or her coach to analyze and manipulate the data recorded by the sensor package and use that data to further improve and operators swing.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A training bat for improving a baseball player's swing comprising:

a rod having a proximal end and a distal end;

a knob at the proximal end of the rod;

a barrel region at the distal end of the rod;

a handle around and slidably engaged with the rod, wherein the handle is located immediately distal to the knob;

wherein the handle comprises an acoustic chamber, a body and an amplifying chamber, and wherein the acoustic chamber is defined by a cylindrical wall and a tympanic panel, and the knob comprises a percussion panel on its distal side that emits a cracking sound when it comes into contact with the tympanic panel of the acoustic chamber.

2. The training bat of claim 1 wherein the cylindrical wall of the acoustic chamber conceals the point of impact between the percussion panel and the tympanic panel.

* * * * *